United States Patent [19]

Ponza

[11] Patent Number: 4,676,504

[45] Date of Patent: Jun. 30, 1987

[54] TENNIS AND BASEBALL DISPENSING APPARATUS

[76] Inventor: Larry J. Ponza, 910 Columbia St., Santa Cruz, Calif. 95060

[21] Appl. No.: 820,089

[22] Filed: Jan. 21, 1986

[51] Int. Cl.[4] ..... A63B 69/40

[52] U.S. Cl. ..... 273/26 D; 124/7; 124/38; 124/49

[58] Field of Search ..... 273/26 D, 29 A, 30; 124/4, 6, 7, 8, 49, 41, 50, 36, 16

[56] References Cited

U.S. PATENT DOCUMENTS

| | | | |
|---|---|---|---|
| 2,192,608 | 3/1940 | Butterworth | 124/6 |
| 2,696,204 | 12/1954 | Gilgoff | 124/7 |
| 3,511,225 | 5/1970 | Yokoi | 124/7 |
| 3,948,242 | 4/1976 | Haworth | 124/7 |
| 4,254,755 | 3/1981 | Morgan et al. | 124/7 |
| 4,262,648 | 4/1981 | Wegner | 124/6 |
| 4,368,885 | 1/1983 | Katada | 273/29 A |
| 4,409,953 | 10/1983 | Kennedy | 124/7 |

FOREIGN PATENT DOCUMENTS

| | | | |
|---|---|---|---|
| 2355830 | 5/1974 | Fed. Rep. of Germany | 124/7 |
| 2818271 | 11/1979 | Fed. Rep. of Germany | 273/29 A |
| 2495476 | 6/1982 | France | 273/29 A |

*Primary Examiner*—Richard C. Pinkham
*Assistant Examiner*—T. Brown

[57] ABSTRACT

Ball dispensing apparatus for hitting practice includes a ball retainer for retaining and sequentially delivering balls to one end thereof, a lever rotatably mounted on a shaft at the one end of the retainer for engaging and lifting a ball from the retainer upon rotation of the lever, and an actuator for the lever for causing the lever to engage, lift, and project a ball from the retainer. A spring is attached to the retainer and to the shaft for accelerating the rotation of the lever into engagement with the ball. The tension of the spring can be varied thereby varying the trajectory of a ball lifted from the retainer.

7 Claims, 5 Drawing Figures

TENNIS AND BASEBALL DISPENSING APPARATUS

This invention relates generally to tennis and baseball batting practice apparatus, and more particularly the invention relates to apparatus for sequentially delivering and variably delivering balls to a player for hitting practice.

A number of devices are known for use in delivering tennis balls and baseballs to players for hitting practice. See, for example, U.S. Pat. Nos. 3,999,753 and 4,021,036 for tennis ball delivery apparatus and U.S. Pat. Nos. 2,955,823 and 4,538,810 for baseball delivery apparatus. These devices utilize tubular chutes or frames for holding and gravitationally feeding balls to the delivery apparatus. In the tennis delivery device of the U.S. Pat. No. 3,999,753 the delivery apparatus comprises a sock suspended from a pivotal ring located at one end of the ball chute. The U.S. Pat. No. 4,021,036 apparatus drops balls vertically from the end of the chute. The U.S. Pat. No. 2,955,823 relies on the sequential gravitational feed of the balls to a wire runway from which the balls leave along a path or trajectory. The U.S. Pat. No. 4,538,810 gravitationally feeds released balls down a chute to engage a cantilevered spring for deflection upward to a position for hitting by a batter.

The present invention is directed to an improved ball delivery apparatus in which the trajectory of the released balls can be readily varied. The apparatus comprises a ball retainer for retaining and sequentially delivering balls to one end thereof, a rotatably mounted lever at the one end for engaging and lifting a ball from the retainer upon rotation of the lever, and actuator means for the rotatably mounted lever for causing the lever to engage, lift, and project a ball from the retainer.

In a preferred embodiment the actuator means comprises a motor having a drive shaft means, the lever being mounted on a first shaft, and spring means attached to the shaft for accelerating the lever into engagement with a ball. Preferably one end of the spring means is adjustably attached to the ball retainer and the other end of the spring means is attached to the shaft by means of an arm extending from the shaft. The drive shaft means includes a motor having a drive shaft, the drive shaft being coupled to drive the first shaft by suitable means such as a crank and pin engaging a thrust pin extending from the first shaft. Thus, as the lever is rotated away from the spring, the spring is placed in tension. As the lever rotates towards the spring, the shaft passes over center and the spring accelerates the advancement of the lever into engagement with a ball at one end of the retainer. The height and distance of ball trajectory is readily adjusted by the tensioning of the spring.

The invention and objects and features thereof will be more readily apparent from the following detailed description and appended claims when taken with the drawing, in which:

Figure 1:
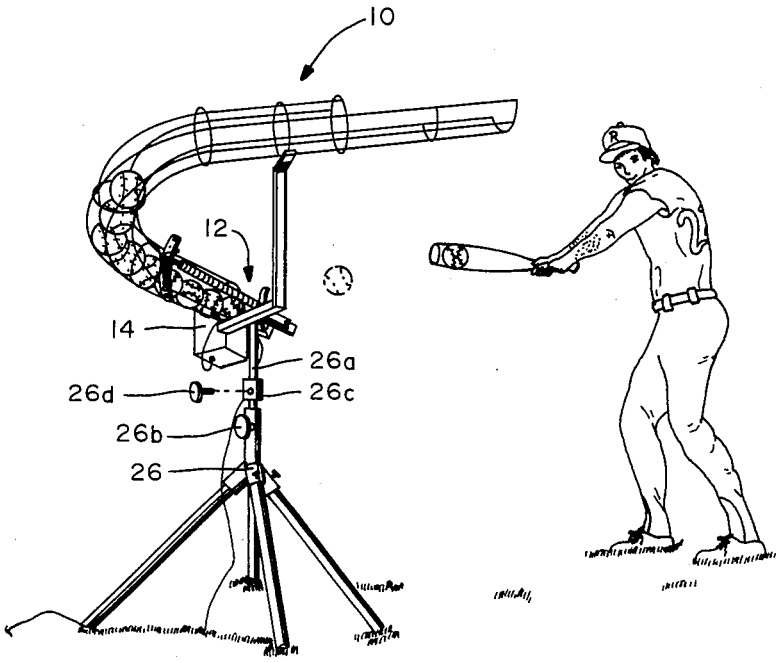
FIG. 1 is an illustrative embodiment of ball dispensing apparatus in accordance with the invention and use thereof.

Referring now to the drawing, FIG. 1 is an illustrative embodiment of ball dispensing apparatus in accordance with the invention and illustrates operation thereof in sequentially delivering balls to a hitter for hitting practice. The apparatus comprises a ball retainer 10 for retaining and sequentially delivering balls by gravity to one end thereof. In this embodiment the retainer comprises a plurality of rods which are configured for receiving and gravitationally delivering balls to the one end 12. As more particularly shown in FIG. 2, mounted to the retainer at the one end 12 is a motor 14 which drives a shaft 16 projecting across the end 12 of the retainer 10. Mounted on the shaft 16 is a lever 18 of suitable length and configuration for engaging the endmost ball 19 in retainer 10 as the lever 18 is rotated on shaft 16 by motor 14. The apparatus includes a spring 20 having one end attached to the retainer 10 by means of a chain 21, and the other end is attached by member 22 to arm 24 mounted to the shaft 16 for accelerating lever 18 into engagement with the endmost ball 19 thereby lifting and projecting the ball on a variable trajectory for hitting by a player shown generally at 22 in FIG. 1. The apparatus includes a stand 26 which is adjustable in height to further vary the trajectory of a ball from the chute to the area for hitting by the player 22. Support shaft **26*a* is vertically movable within stand 26 and can be fastened at a desired height by means of set screw 26*b*. Advantageously, collar 26*c* can be fastened to shaft 26*a* by means of set screw 26*d*, and the chute can be rotated on stand 26 when set screw 26*b* is loosened and collar 26*c* engages the upper end of stand 26**. Accordingly, a person can vary the direction of balls to the hitter by swiveling the chute.

Figure 2:
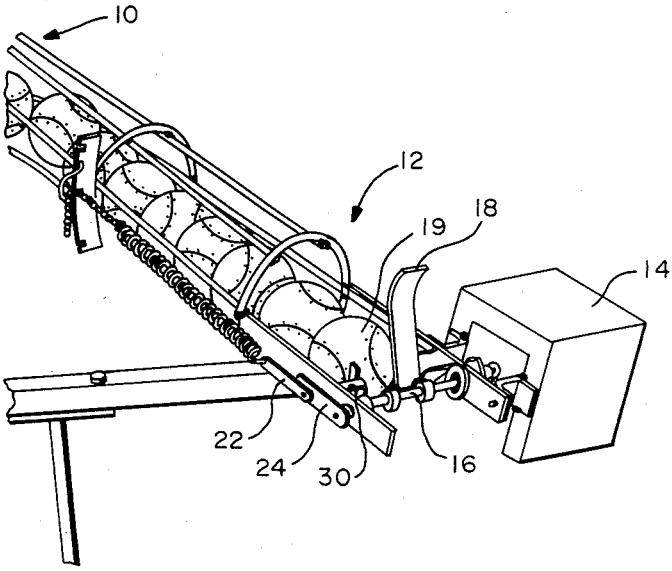
FIG. 2 is a perspective view of a rotatably mounted lever and actuator means in the apparatus of FIG. 1.
Figure 3:
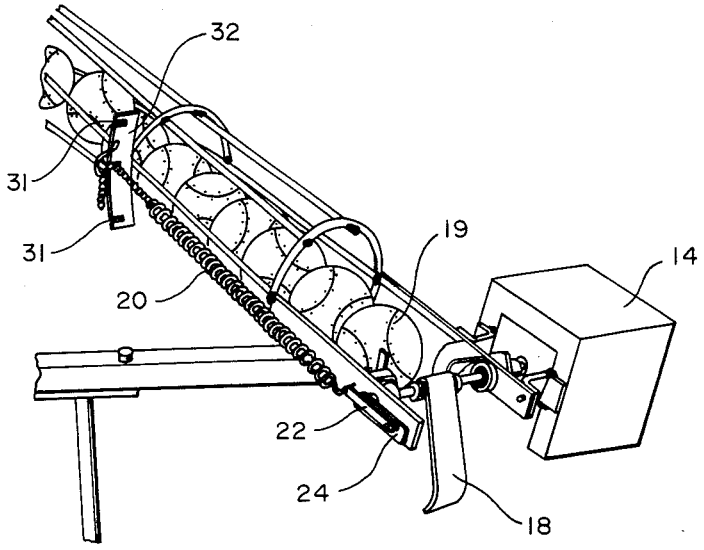
FIG. 3 and FIG. 4 are perspective views of the lever and actuator means of FIG. 2 illustrating the operation of the spring means in accelerating the lever into engagement wit a ball and projecting the ball to a hitter.
Figure 4:
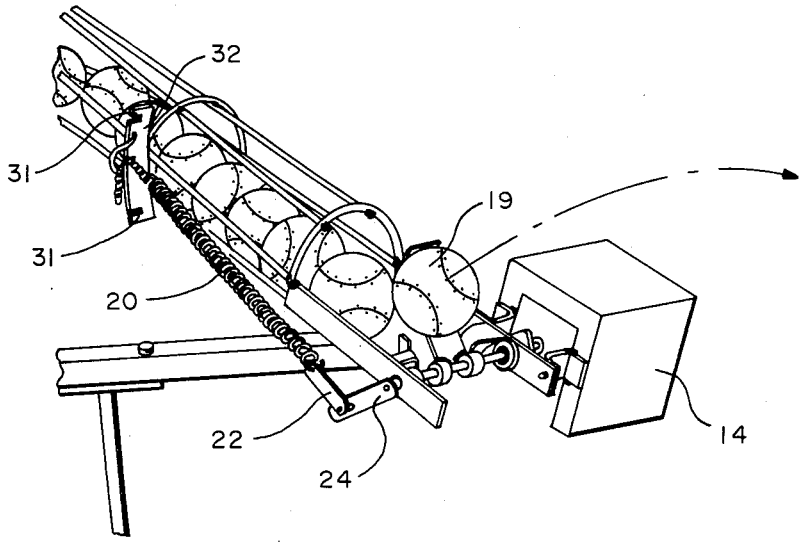

Consider now FIGS. 2–4 which are perspective views further illustrating the motor 14, drive shaft 16, lever 18, and spring 20. The balls in retainer 10 are gravitationally fed to the end 12 where they engage a stop 30. The lever 18 is positioned above a ball so that the retained balls can advance following the removal and projection of a ball to be hit. Spring 20 is mounted to the shaft 16 by means of the member 22 and arm 24 and is mounted to the retainer 10 by means of the chain 21 which adjustably engages a sLot 31A–31C in member 32 extending from the retainer 10. Thus the tension of the spring can be varied by the positioning of the chain 34 in the slot. By engaging chain 20 in one of slots 31A, 31B, and 31C (FIGS. 3 and 4), the operator can vary the height trajectory of tossed ball at any tension.

As the motor rotates the shaft as illustrated in FIG. 3, the spring is stretched in tension as the lever 18 approaches the engagement of a ball. As illustrated in FIG. 4, once arm 24 passes center and begins rotating towards the spring, the spring is released and causes the lever 18 to accelerate into engagement with a ball and project the ball upward to a hitting position as indicated by the arrow and as illustrated in FIG. 1.

Figure 5:
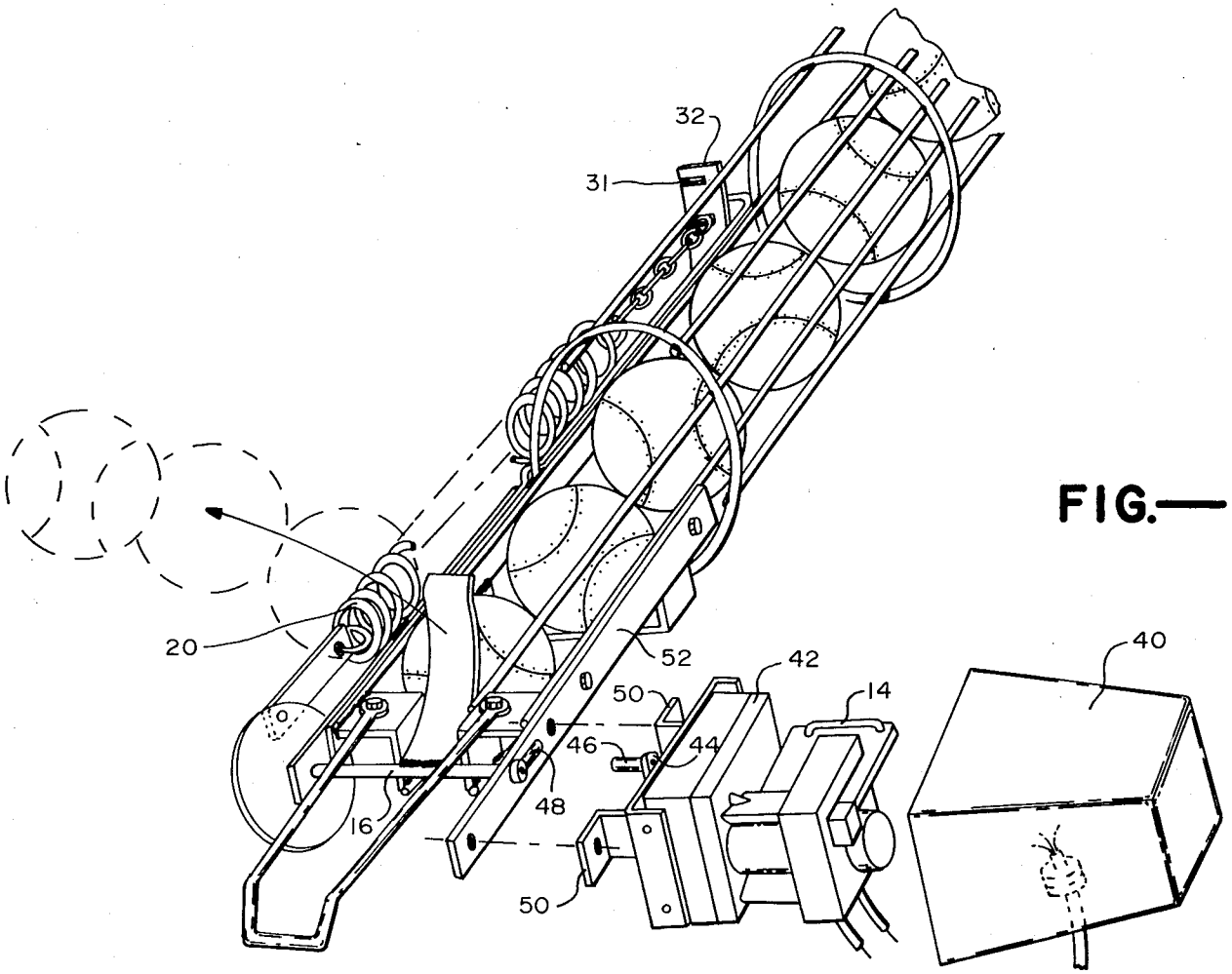
FIG. 5 is an exploded perspective view that illustrates the mounting of the drive motor in the apparatus and the engagement with the lever arm shaft.

FIG. 5 is an exploded perspective view of the mounting of the drive motor 14 to the apparatus and the engagement with the shaft 16. The motor includes a housing 40 and a gear box 42 which permits the motor to drive a crank 44 at a slow speed, 12 rpm for example. a slow speed, 12 rpm A pin 46 on crank 44 engages a thrust pin 48 on the shaft 16. Thus while the motor drives shaft 16 by pin 46 pushing on thrust pin 48, the spring 20 can accelerate rotation of the shaft 16 as described above. Brackets 50 are bolted to a bracket 52 on the ball retainer 10.

By eliminating the spring tension of spring 20 and adding bracket 58 to the end of retainer 10, the apparatus can be used to feed balls to a conventional pitching machine placed in juxtaposition with the bracket 58.

Ball dispensing apparatus in accordance with the invention has proved to be particularly versatile in allowing the user to vary the trajectory of a ball from the apparatus to a hitting position. The apparatus is useful with tennis balls, baseballs, and softballs. Thus, while the ball dispensing apparatus has been described with reference to a specific embodiment, the description is illustrative of the invention and is not to be construed as limiting the invention. Various modifications and applications may occur to those skilled in the art without departing from the true spirit and the scope of the invention as defined by the appended claims.

What is claimed is:

1. Ball dispensing apparatus comprising a ball retainer for retaining and sequentially delivering balls to one end thereof, said ball retainer gravitationally feeding balls to said one end, said one end having a stop for limiting travel of a ball in said retainer, a rotatably mounted lever mounted on a first shaft at said one end for engaging and lifting a ball from said retainer upon rotation of said lever, actuator means for said rotatably mounted lever for causing said lever to engage, lift, and project a ball from said retainer, said actuator means comprising a motor having a drive shaft, said first shaft being coupled to said drive shaft, and spring means attached to said first shaft for accelerating said lever into engagement with a ball, said spring means being adjustable in tension to vary the projection of a ball by said lever with one end of said spring means being adjustably attached to said ball retainer and the other end of said spring means attached to said first shaft, and a vertically adjustable mount for supporting said ball retainer, said ball retainer being rotatable on said mount whereby direction of balls to a hitter can be varied by swiveling said ball retainer.

2. The ball dispensing apparatus as defined by claim 1 wherein said retainer comprises a plurality of rods configured to receive and gravitationally feed balls.

3. The ball dispensing apparatus as defined by claim 1 wherein said drive shaft includes a gear assembly for reducing the speed of said motor, said gear assembly including a crank and pin for engaging a thrust pin extending from said first shaft.

4. The ball dispensing apparatus as defined by claim 1 wherein said ball retainer includes a bracket having a plurality of slots, said spring means engaging one of said slots to vary spring tension and alter the trajectory of a projected ball.

5. The ball dispensing apparatus as defined by claim 1 and further including bracket means at said one end for receiving a ball for delivery to a pitching machine.

6. The ball dispensing apparatus as defined by claim 1 wherein said ball retainer includes a vertical support rod, said vertically adjustable mount further including a support stand for receiving said support rod.

7. The ball dispensing apparatus as defined by claim 6 and further including collar means on said support rod for engaging said support stand and permitting the swiveling of said ball retainer on said support stand.

* * * * *